US009434577B2

(12) United States Patent
Benosman

(10) Patent No.: US 9,434,577 B2
(45) **Date of Patent: *Sep. 6, 2016**

(54) SEMI-ACTIVE FEEDBACK CONTROL OF ELEVATOR ROPE SWAY

(71) Applicant: Mitsubishi Electric Research Laboratories, Inc., Cambridge, MA (US)

(72) Inventor: Mouhacine Benosman, Boston, MA (US)

(73) Assignee: Mitsubishi Electric Research Laboratories, Inc., Cambridge, MA (US)

( * ) Notice: Subject to any disclaimer, the term of this patent is extended or adjusted under 35 U.S.C. 154(b) by 520 days.

This patent is subject to a terminal disclaimer.

(21) Appl. No.: 13/948,872

(22) Filed: Jul. 23, 2013

(65) Prior Publication Data

US 2015/0027814 A1 Jan. 29, 2015

(51) Int. Cl.
*B66B 1/34* (2006.01)
*B66B 5/02* (2006.01)
*B66B 7/06* (2006.01)

(52) U.S. Cl.
CPC .. *B66B 5/02* (2013.01); *B66B 7/06* (2013.01)

(58) Field of Classification Search
CPC ..... B66B 7/08; B66B 7/068; B66B 5/02
USPC ..... 187/247, 250, 251, 254, 256, 258, 264, 187/277, 278, 391, 393, 411–414; 182/142, 182/144, 150; 702/142, 144, 150
See application file for complete search history.

(56) References Cited

U.S. PATENT DOCUMENTS

| | | | | |
|---|---|---|---|---|
| 4,106,594 | A * | 8/1978 | Kirsch | B66B 5/022 187/278 |
| 5,509,503 | A | 4/1996 | Salmon | |
| 5,861,084 | A * | 1/1999 | Barker | B66B 7/10 187/264 |
| 6,488,125 | B1 * | 12/2002 | Otsuka | B66B 7/068 187/254 |
| 7,117,978 | B2 * | 10/2006 | Kaczmarek | B66B 7/068 187/251 |
| 7,793,763 | B2 | 9/2010 | Zhu et al. | |
| 9,038,783 | B2 * | 5/2015 | Roberts | B66B 7/08 187/391 |
| 9,045,313 | B2 * | 6/2015 | Benosman | B66B 7/06 |
| 9,096,411 | B2 * | 8/2015 | Benosman | B66B 7/06 |
| 2009/0229922 | A1 | 9/2009 | Smith | |
| 2012/0125720 | A1 | 5/2012 | Roberts | |
| 2014/0069747 | A1 * | 3/2014 | Benosman | B66B 7/06 187/414 |
| 2014/0124300 | A1 * | 5/2014 | Benosman | B66B 7/06 187/247 |
| 2014/0229011 | A1 * | 8/2014 | Fukui | B66B 7/06 700/275 |
| 2015/0008075 | A1 * | 1/2015 | Benosman | B66B 7/06 187/247 |

* cited by examiner

*Primary Examiner* — Anthony Salata
(74) *Attorney, Agent, or Firm* — Gene Vinokur; James McAleenan; Hironori Tsukamoto

(57) ABSTRACT

A method controls an operation of an elevator system. The method receives an amplitude of a sway of an elevator rope and a velocity of the sway of the elevator rope determined during the operation of the elevator system. The method modifies a damping coefficient of a semi-active damper actuator connected to the elevator rope according to a function of the amplitude and the velocity of the sway.

17 Claims, 10 Drawing Sheets

200

SEMI-ACTIVE FEEDBACK CONTROL OF ELEVATOR ROPE SWAY

FIELD OF THE INVENTION

This invention relates generally to elevator systems, and more particularly to reducing a sway of an elevator rope in an elevator system.

BACKGROUND OF THE INVENTION

Typical elevator systems include a car and a counterweight moving along guiderails in a vertical elevator shaft above or below ground. The car and the counterweight are connected to each other by hoist ropes. The hoist ropes are wrapped around a grooved sheave located in a machine room at the top or bottom of the elevator shaft. The sheave can be moved by an electrical motor, or the counterweight can be powered by a linear motor.

Rope sway refers to oscillation of the hoist and/or compensation ropes in the elevator shaft. The oscillation can be a significant problem in a roped elevator system. The oscillation can be caused, for example, by wind induced building deflection and/or the vibration of the ropes during operation of the elevator system. If the frequency of the vibrations approaches or enters a natural harmonic of the ropes, then the oscillations can be greater than the displacements. In such situations, the ropes can tangle with other equipment in the elevator shaft, or come out of the grooves of the sheaves. If the elevator system uses multiple ropes and the ropes oscillate out of phase, then the ropes can become entangled to cause a safety risk, and the elevator system may be damaged.

Various conventional methods control the sway of the elevator rope by applying tension to the rope. However, those methods use a constant control action to reduce the rope sway. For example, the method described in U.S. Pat. No. 5,861,084 and U.S. Patent Publication 20120125720 minimizes horizontal vibration of elevator compensation ropes by applying a constant tension on the rope after the vibration of the rope is detected. However, applying a constant tension to the rope is suboptimal, because the constant tension can cause unnecessary stress to the ropes.

Another method, described in U.S. Patent Publication 2009/0229922, uses a servo-actuator that moves the sheave to shift the natural frequency of the compensation ropes to avoid resonance of compensation ropes with the natural frequency of the building. The servo-actuator is controlled by feedback that uses the velocity of the rope vibration at the extremity of the rope. However, that method only solves the problem of compensation rope vibration sway damping. Furthermore, that method necessitates the measurement of the ropes sway velocity at the extremity of the rope, which is difficult in practical applications.

The method described in U.S. Pat. No. 7,793,763 minimizes vibration of the main ropes of the elevator system using a passive damper mounted on the top of the car. The damper is connected to the car and the rope. Distances and a value of the damping coefficient of the damper are predetermined and used to reduce the rope sway. However, the damper is passive and engages continuously with the rope, which can induce unnecessary extra stress on the ropes.

Other methods, see, e.g., U.S. Pat. No. 4,460,065 and U.S. Pat. No. 5,509,503, use purely mechanical solutions to limit the sway amplitude by physically limiting the lateral motion of the rope. Those types of solutions can be costly to install and maintain.

Accordingly, there is a need to a more optimal approach to reduce the sway of the elevator rope.

SUMMARY OF THE INVENTION

It is an objective of some embodiments of an invention to provide a system and a method for reducing a sway of an elevator rope connected to an elevator car in an elevator system by applying damping forces to the ropes. For example, one embodiment of the present invention uses a semi-active damper actuator connected between the elevator ropes and the elevator car to apply a damping force the elevator ropes. Another embodiment uses a semi-active damper actuator connected between the elevator ropes and the elevator counterweight to apply a damping force the elevator ropes.

It is another objective of the embodiments, to provide a method that applies the damping force optimally, e.g., only when necessary, such that maintenance of components of the elevator system can be decreased. For example, one embodiment of an invention updates a damping coefficient of the semi-active damper actuator according to a function of the amplitude and the velocity of the sway. The embodiment reduces a lateral rope sway of elevator ropes by applying time varying damping force on the ropes.

Embodiments of the invention are based on a realization that the damping force applied to the elevator rope can be used to stabilize the elevator system. Therefore, the damping force can be analyzed based on stability of the elevator system using a model of the elevator system. Various types of stability are used by embodiments for solutions of differential equations describing a dynamical system representing the elevator system.

For example, some embodiments require the dynamical system representing the elevator system to be Lyapunov stable. Specifically, the stabilization of the elevator system can be described by a control Lyapunov function, wherein the damping force of the elevator rope stabilizing the elevator system is determined by a control law, such that a derivative of a Lyapunov function along dynamics of the elevator system controlled by the control law is negative definite. The Lagrangian variables representing the assumed mode of the dynamical system and its time derivative are related to the sway and velocity of the sway. The control Lyapunov function is a function of the Lagrangian variables, and thus, the control law determined using the control Lyapunov function can be related to the sway and velocity of the sway.

One embodiment determines a control law stabilizing a state of the elevator system based on the damping force of an elevator rope using the Lyapunov control theory. Such an approach enables applying the damping force optimally, e.g., only when the damping force is necessary, which decreases the maintenance cost and the overall energy consumption on the system.

One embodiment determines the control law based on a model of the elevator system without external disturbance. This embodiment is advantageous when the external disturbance is minimal or quickly dissipating. Another embodiment modifies the control law with a disturbance rejection component to force the derivative of the Lyapunov function to be negative definite. This embodiment is advantageous for systems with the steady disturbances. In one variation of this embodiment, the external disturbance is measured during the operation of the elevator system. In another variation, the disturbance rejection component is determined based on boundaries of the external disturbance. This embodiment allows for compensating for disturbance without measuring the disturbance. This is advantageous because in general the disturbance measurements are not easily available, e.g. the sensors for external disturbances are expensive.

Also, in one embodiment the damping force has a maximal damping value, and switches to a minimal value, e.g., zero, at an optimal time based on the values of the sway amplitude and the sway velocity. In another embodiment, a magnitude of the damping is a function of the amplitude of the sway and decreases with the decrease of the sway and velocity of the sway. Compared with some other embodiments, this embodiment uses less energy.

Accordingly, one embodiment discloses a method controls an operation of an elevator system. The method receives an amplitude of a sway of an elevator rope and a velocity of the sway of the elevator rope determined during the operation of the elevator system. The method modifies a damping coefficient of a semi-active damper actuator connected to the elevator rope according to a function of the amplitude and the velocity of the sway. Steps of the method can be performed by a processor.

Another embodiment discloses a control unit for controlling an operation of a semi-active damper actuator connected to an elevator rope of an elevator system. The control unit includes a processor for determining a damping coefficient of the semi-active damper actuator according to a function of an amplitude of a sway of an elevator rope and a velocity of the sway of the elevator rope.

Yet another embodiments discloses an elevator system, including an elevator car and a counterweight of the elevator car; an elevator rope connected to the elevator car or to the counterweight; a semi-active damper actuator connected to the elevator rope; a sway unit for determining an amplitude of a sway of an elevator rope and a velocity of the sway of the elevator rope; and a control unit for determining a damping coefficient of the semi-active damper actuator according to a function of the amplitude and the velocity of the sway of the elevator rope.

DETAILED DESCRIPTION OF THE PREFERRED EMBODIMENT

Figure 1A:
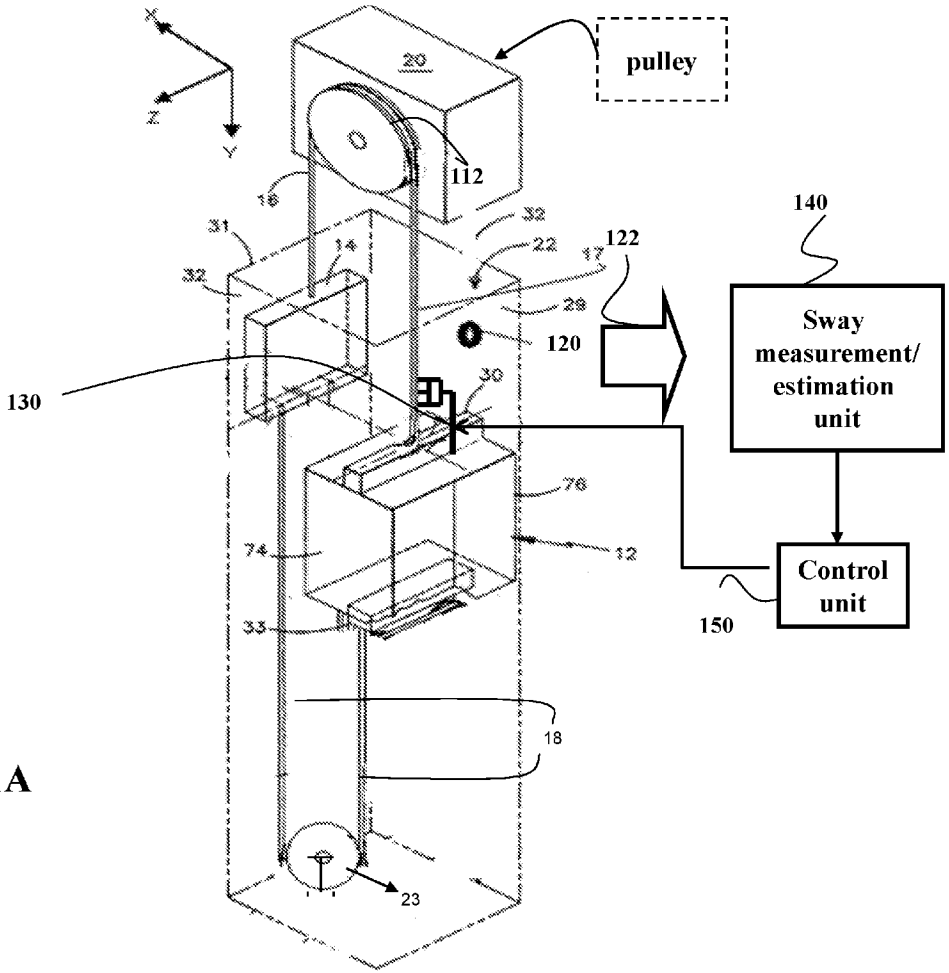
FIGS. 1A, 1B, 1C, and 1D are schematics of elevator systems using various embodiments of the invention.

Vibration reduction in mechanical systems is important for a number of reasons including safety and efficiency of the systems. Particularly, vibration, such as a lateral sway of an elevator rope in the elevator system, is directly related to ride quality and safety of passengers, and, thus, should be reduced.

The vibration induced by, e.g., external disturbance such as wind or seismic activity, can be reduced by various types of suspension systems. Generally, there are passive, semi-active, and active types of the suspension systems. The passive suspension system has undesirable ride quality. The active suspension systems use actuators that can exert an independent force on the suspension to improve the comfort of riding and can provide desirable performance for reducing the vibration. The drawbacks of the active suspension system are increased cost, complication, mass, and maintenance.

The semi-active suspension systems provide a better trade-off between system cost and performance. For example, a semi-active damper actuator allows for the adjustment of parameters, such as viscous damping coefficient or stiffness, and can be used to reduce the vibration, and is reliable because such actuator only dissipates energy.

Some embodiments of the invention are based on a realization that it can be advantageous to reduce the sway of the elevator rope by applying damping force to the elevator rope using semi-active damper actuators, i.e., the semi-active dampers. Such application of the damping force can change the damping of the elevator rope and reduce the sway. In addition, time-varying selection of the damping coefficient of the semi-active dampers can help to reduce the size of the semi-active dampers as compared with the size of passive dampers resulting in the same or similar performance.

However, the elevator system that includes a passive damper can be modeled as a linear system, while the elevator system having semi-active dampers can be modeled only as non-linear system due to the change of the semi-active damper coefficient as function of the states of the elevator ropes, which is more difficult to analyze. Thus, the controlling of the semi-active dampers is more difficult, and incorrect control can increase the sway of the elevator rope.

Various embodiments of the invention are based on a realization that the damping force applied to an elevator rope can be used to stabilize an elevator system. Moreover, the stabilization of the elevator system can be described by a control Lyapunov function, such that the damping force of the elevator rope stabilizing the elevator system ensures the negative definiteness of a derivative of the control Lyapunov function. By combining Lyapunov theory and the rope damping actuation, a switching controller, according to some embodiments, optimizes switching the control ON and OFF based on switching conditions, e.g., amplitude and velocity of the actual sway. The switching conditions, as well as the amplitude of the positive damping to be applied, are obtained based on the Lyapunov theory.

Accordingly, the switching control allows applying damping to the rope only when necessary, i.e., when the switching conditions are met. Therefore, no unnecessary extra damping is applied to parts of the elevator system, such as the elevator ropes and sheaves, which can reduce the cost of the maintenance and the overall energy consumption of the system.

FIG. 1A shows a schematic of an elevator system according to one embodiment of an invention. The elevator system includes an elevator car 12 operably connected by at least one elevator rope to different components of the elevator system. For example, the elevator car and a counterweight 14 connect to one another by main ropes 16-17, and compensating ropes 18. The elevator car 12 can include a crosshead 30 and a safety plank 33. A pulley 20 for moving the elevator car 12 and the counterweight 14 through an elevator shaft 22 can be located in a machine room (not shown) at the top (or bottom) of the elevator shaft 22. The elevator system can also include a compensating pulley 23. An elevator shaft 22 includes a front wall 29, a back wall 31, and a pair of side walls 32.

The elevator car and the counterweight have a center of gravity at a point where summations of the moments in the x, y, and z directions are zero. In other words, the car 12 or counterweight 14 can theoretically be supported and balanced at the center of gravity (x, y, z), because all of the moments surrounding the center of gravity point are cancel out. The main ropes 16-17 typically are connected to the crosshead 30 of the elevator car 12 where the coordinates of the center of gravity of the car are projected. The main ropes 16-17 are connected to the top of the counterweight 14 the coordinates of the center of gravity of the counterweight 14 are projected.

During the operation of the elevator system, different components of the system are subjected to internal and external disturbance, e.g., sway due to wind, resulting in lateral motion of the components. Such lateral motion of the components can result in a sway of the elevator rope that needs to be measured. Accordingly, one or a set of sway sensors 120 can be arranged in the elevator system to determine a lateral sway of the elevator rope.

The set of sensors may include at least one sway sensor 120. For example, the sway sensor 120 is configured to sense a lateral sway of the elevator rope at a sway location associated with a position of the sway sensor.

However, in various embodiments, the sensors can be arranged in different positions such that the sway locations are properly sensed and/or measured. The actual positions of the sensors can depend on the type of the sensors used. For example, the sway sensor can be any motion sensor, e.g., a light beam sensor.

In one embodiment, a first sway sensor is placed at a neutral position of the rope corresponding to the initial rope configuration, i.e., no rope sway. The other sway sensors are arranged away from the neutral position and at the same height as the first sway sensor.

During the operation of the elevator system, the locations of the sway are determined and transmitted 122 to a sway measurement and estimation unit 140. The sway unit 140 determines a state of the sway of the elevator rope, e.g., amplitude and a velocity of the sway. The sway unit can determine the state of the sway based only on the sway measurements. In alternative embodiment, the sway unit determines the state of the sway using the sway measurement and a model of the elevator system. Various embodiments use different inverse models, e.g., an inverse model of the elevator system including the rope the pulley and the car, also various embodiments use different estimation method for estimating the rope sway from the measurements.

In the system of FIG. 1A, the rope sway is controlled by a semi-active damper actuator 130 mounted on the top of the elevator car 12 and operatively connected to the elevator rope, such that the semi-active damper can apply damping force to the elevator rope. The actuator 130 is controlled by the control unit 150 that calculates the amplitude of the damping coefficient of the semi-active damper to change the damping force applied to the elevator rope. The control unit also determines the time when the damping force is ON and when the damping force is OFF. The timing of the switching is based on the rope sway measurements obtained from the sway unit 140.

In the embodiment of FIG. 1A, the semi-active damper applies damping force to the main elevator rope. However, in different embodiments, the arrangement of the semi-dampers varies and the damping force is applied to the different elevator ropes. In addition, in some embodiments, multiple semi-active dampers are used to apply damping force to the same or different elevator ropes.

Figure 1B:
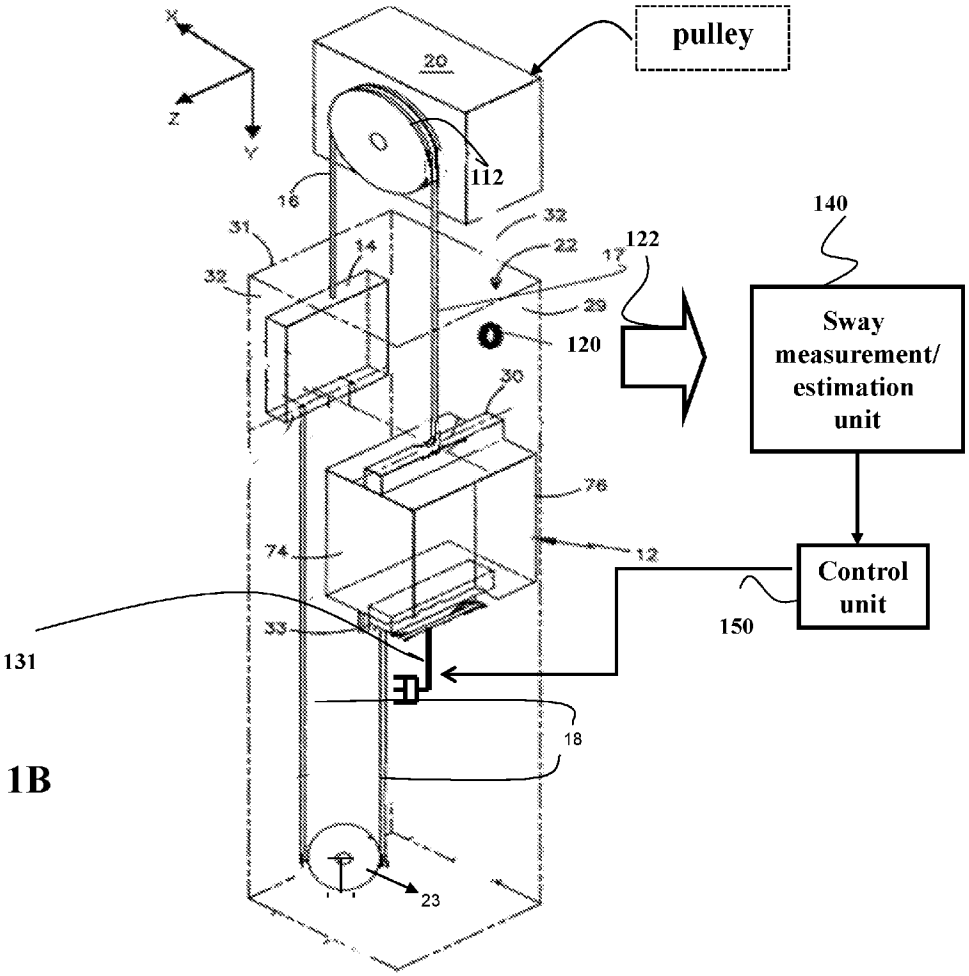

For example, FIG. 1B shows a schematic of the elevator system according to another embodiment. In this embodiment, the rope sway is controlled by a semi-active damper actuator 131 mounted on the bottom of the elevator car 12.

Figure 1C:
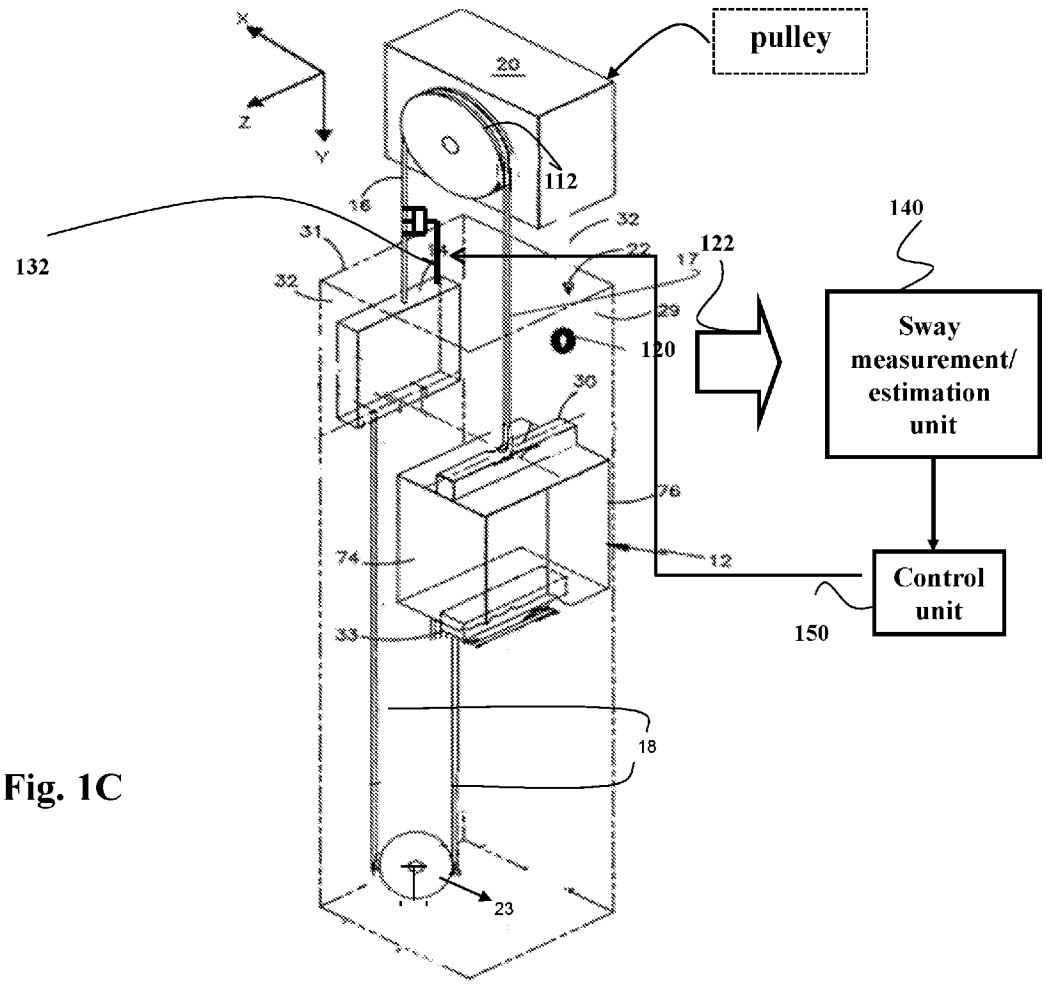

FIG. 1C shows a schematic of the elevator system according to another embodiment. In this embodiment, the rope sway is controlled by a semi-active damper actuator 132 mounted on the top of the elevator counterweight 14.

Figure 1D:
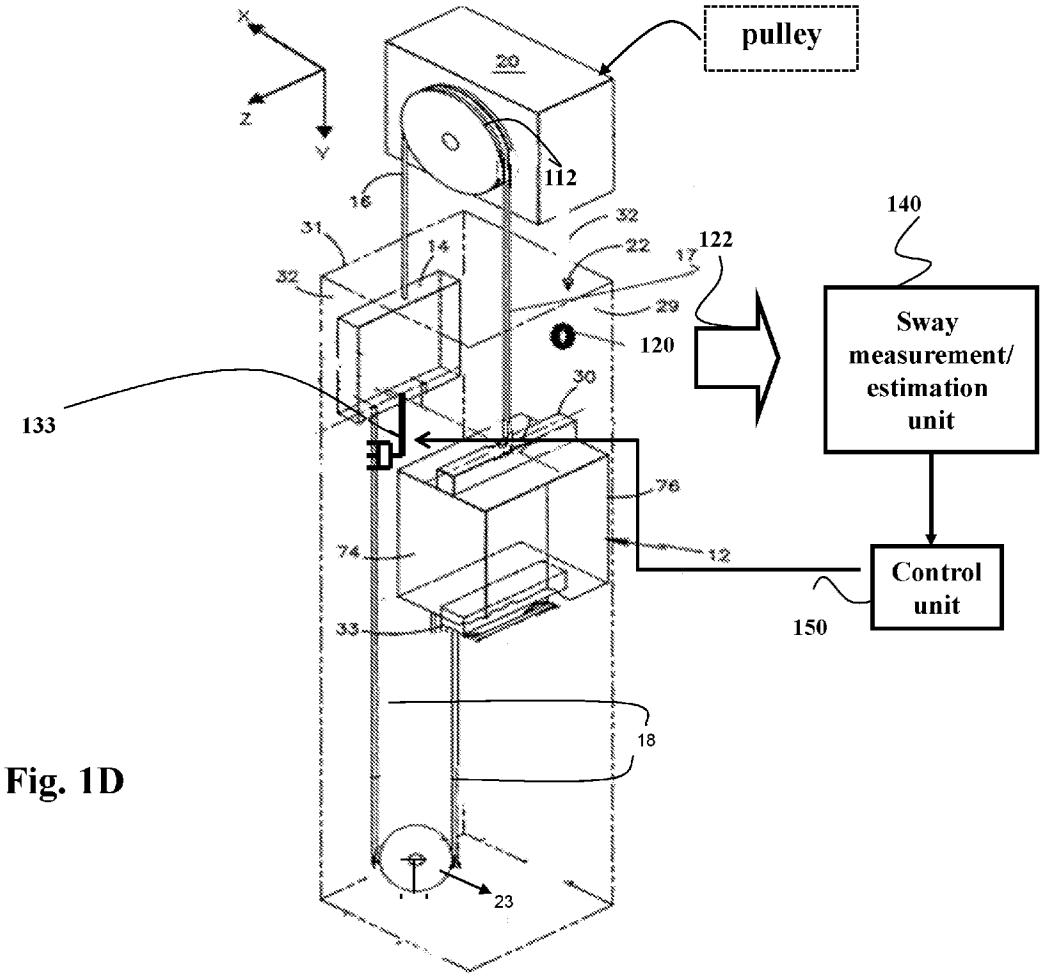

FIG. 1D shows a schematic of the elevator system according to another embodiment. In this embodiment, the rope sway is controlled by a semi-active damper actuator 133 mounted on the bottom of the elevator counterweight 14.

Figure 1E:
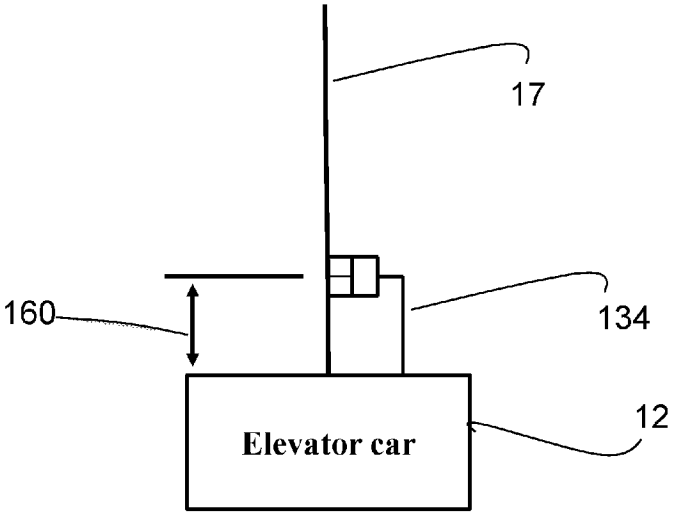
FIG. 1E is a schematic of arrangement of a semi-active damper actuator according to one embodiment of the invention.

FIG. 1E shows a schematic of arrangement of the semi-active damper actuator 134. The semi-active damper 134 is connected to a roof of the elevator car 12 and to the elevator rope 17 at a distance 160 from the elevator car. The semi-active damper can be affixed or attached movably to the elevator rope. When the elevator rope oscillates, the semi-active damper exerts the damping force in a direction opposite the direction of the motion of the elevator rope and damps the oscillation of the elevator rope.

Model Based Control Design

Figure 2:
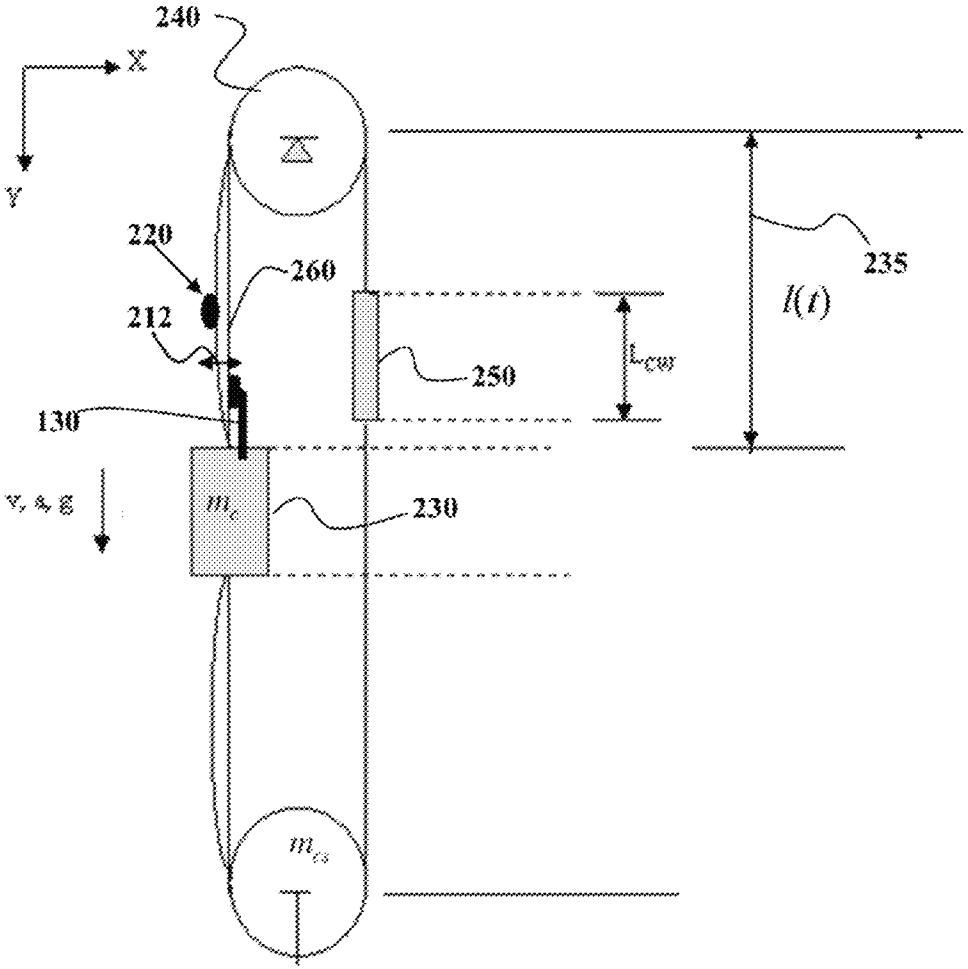
FIG. 2 is a schematic of a model of the elevator system according to an embodiment of the invention.

FIG. 2 shows an example of a model 200 of the elevator system. The model 200 is based on parameters of the elevator system shown in FIG. 1A. The parameters and the models of other elevator systems can be similarly derived. Various methods can be used to simulate operation of the elevator system according to the model of the elevator system, e.g., to simulate an actual sway 212 of the elevator rope caused by operating the elevator system sensed by a sway sensor 220.

Various embodiments can use different models of the elevator system to design the control law. For example, one embodiment performs the modeling based on Newton's second law. For example, the elevator rope is modeled as a string and the elevator car and the counterweight are modeled as rigid bodies 230 and 250, respectively.

In one embodiment, the model of the elevator system controlled with a semi-active damper actuator is determined by an ordinary differential equation (ODE) according to $$M\ddot{q}+(C+G+\tilde{C}U)\dot{q}+(K+H+\beta U)q=F(t)+\tilde{F}(t)U, \quad (1)$$

wherein $q=[q_1, \ldots, q_N]$ is a Lagrangian coordinate vector, $\dot{q}$, $\ddot{q}$ are the first and second derivatives of the Lagrangian coordinate vector with respect to time, N is a number of vibration modes. The Lagrangian variable vector q defines the lateral rope displacement, i.e., the sway u(y, t) 212 by $$u(y, t) = \sum_{j=1}^{j=N} q_j(t)\psi_j(y, t) + \frac{l-y}{l} f_1(t) + \frac{y}{l} f_2(t)$$

$$\psi_j(y, t) = \frac{\phi_j(\xi)}{\sqrt{l(t)}},$$

wherein $\phi_j(\xi)$ is a $j^{th}$ shape function of the dimensionless variable $\xi=y/l$.

In Equation (1), M is an inertial $\tilde{C}U$ matrix, (C+G+$\tilde{C}$U) constructed by combining a centrifugal matrix and a Coriolis matrix, (K+H) is a stiffness $\tilde{F}U$ matrix and F(t)+$\tilde{F}$U is a vector of external forces. The elements of these matrices and vector are given by:

$$M_{ij} = \rho\delta_{ij}$$

$$K_{ij} = \frac{1}{4}\rho l^{-2}\dot{l}^2\delta_{ij} - \rho l^{-2}\dot{l}^2\int_0^1 (1-\xi)^2\phi_i'(\xi)\phi_j'(\xi)\,d\xi + \rho l^{-1}(g+\ddot{l})\int_0^1 (1-\xi)\phi_1'(\xi)\phi_j'(\xi)\,d\xi + m_e l^{-2}(g+\ddot{l})\int_0^1 \phi_i'(\xi)\phi_j'(\xi)\,d\xi + \frac{1}{2}M_{cs}gl^{-2}\int_0^1 \phi_i'(\xi)\phi_j'(\xi)\,d\xi$$

$$H_{ij} = \rho(l^{-2}\dot{l}^2 - l^{-1}\ddot{l})\left(\frac{1}{2}\delta_{ij} - \int_0^1 (1-\xi)\phi_1'(\xi)\phi_j'(\xi)\,d\xi\right) - c_p\dot{l}l^{-1}\left(\int_0^1 \phi_1'(\xi)\phi_j'(\xi)\,d\xi + 0.5\delta_{ij}\right)$$

$$G_{ij} = \rho l^{-1}\dot{l}\left(2\int_0^1 (1-\xi)\phi_i(\xi)\phi_j'(\xi)\,d\xi - \delta_{ij}\right)$$

$$C_{ij} = c_p\delta_{ij}$$

$$F_i(t) = -l\sqrt{l}\,(\rho s_1(t) + c_p s_4(t))\int_0^1 \phi_i(\xi)\xi\,d\xi + \sqrt{l}\,(s_5(t) - \rho f_1^{(2)}(t))\int_0^1 \phi_i(\xi)\,d\xi$$

$$s_5(t) = -2v\rho s_2(t) - g(t)s_3(t) - c_p f_1^{(2)}(t)$$

$$s_1(t) = \frac{\ddot{l}l - 2\dot{l}^2}{l^3}f_1(t) + \frac{\dot{l}}{l^2}\dot{f}_1(t) + \frac{\dot{l}}{l^2}\dot{f}_1(t) + \frac{1}{l^4}\left(l^3 f_2^{(2)}(t) - f_2(t)l^2 l^{(2)} + 2l\dot{l}^2 f_2(t) - 2l^2\dot{l}\dot{f}_2(t)\right) - \frac{\ddot{f}_1(t)}{l}$$

$$s_2(t) = \frac{\dot{l}}{l^2}f_1(t) - \frac{\dot{f}_1}{l} + \frac{\dot{f}_2}{l} - f_2\frac{\dot{l}}{l^2}$$

$$s_3(t) = \frac{f_2(t) - f_1(t)}{l}$$

$$s_4(t) = \frac{\dot{l}}{l^2}f_1(t) - \frac{\dot{f}_1}{l} + \frac{\dot{f}_2 l - f_2\dot{l}}{l^2}$$

$$\phi_i(\xi) = \sqrt{2}\sin(\pi i\xi),\ \delta_{ij}(\text{kronecker delta})$$

$$\tilde{C}_{ii} = l^{-1}2\sin(\pi(l-l_{dp})/l)\sin(\pi(l-l_{dp})/l),$$

$$\tilde{F}_i(t) = \dot{f}_1\frac{1}{\sqrt{l}}\Phi_i\left(\frac{l-l_{dp}}{l}\right) + \frac{l-l_{dp}}{\sqrt{l}}\Phi_i\left(\frac{l-l_{dp}}{l}\right)[l^{-1}(\dot{f}_2 - \dot{f}_1)],$$

$$U = k_{dp},$$

$$\beta_{ii} = \dot{l}l^{-2}\left(-\Phi_i'\left(\frac{l-l_{dp}}{l}\right)\Phi_i\left(\frac{l-l_{dp}}{l}\right)\left(\frac{l_{dp}}{l}\right) - 0.5\Phi_i^2\left(\frac{l-l_{dp}}{l}\right)\right),$$

wherein $\dot{s}(.)$ is a first derivative of a function s with respect to its variable, the notation $s^{(2)}(.)$ is a second derivative of the function s with respect to its variable, and $$\int_{v0}^{vf} s(v)\,dv$$

is an integral of the function s with respect to its variable v over the interval [$v_0$, $v_f$]. The Kronecker delta is a function of two variables, which is one if the variables are equal and zero otherwise, ρ is the mass of the rope per unit length, c is a damping coefficient of the elevator rope per unit length, $f_1(t)$ is the first boundary condition representing the top building sway due to external disturbances, e.g. wind conditions, $f_2(t)$ is the second boundary condition representing the car sway due to external disturbances, e.g. wind conditions, l(t) is the length of the elevator rope 260 between the main sheave 112 and the elevator car 12, $m_e$, $m_{cs}$ are the mass of the elevator car and the pulley 240 respectively, g is the gravity acceleration, i.e., g=9.8 m/s$^2$, $l_{dp}$ is the distance 160 between the top of the elevator car and the point of contact between the semi-active damper actuator and the rope, $k_{dp}$ is the time-varying value of the semi-active damper damping coefficient.

The system model given by Equation (1) is an example of model of the system. Other models based on a different theory, e.g., a beam theory, instead of a string theory, can be used by the embodiments of the invention.

Updating Damping Coefficient of Semi-Active Damper Actuator

The damping force F generated by the a semi-active damper actuator is related to the velocity v of the sway of the elevator rope by $$F = -cv,$$

where c is the damping coefficient of the semi-active damper actuator, e.g., given in units of Newton-seconds per meter.

Figure 3A:
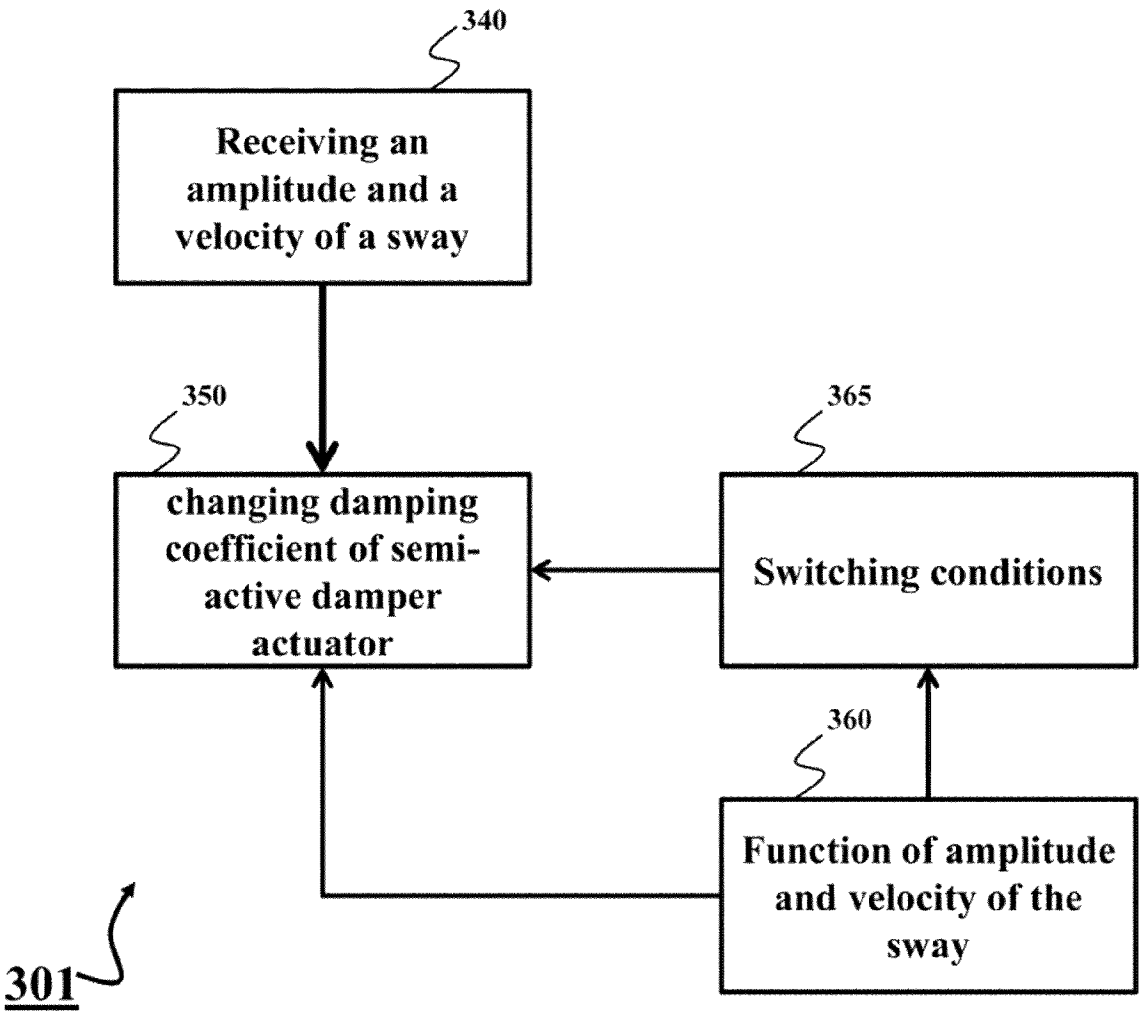
FIG. 3A is a block diagram of a method for controlling an operation of the elevator system by changing a damping coefficient of a semi-active damper actuator according to some embodiments of the invention.

In contrast to the passive damper, it is possible to change the damping coefficient of the semi-active damper actuator during the operation of the actuator. Various embodiments use different types of the semi-active damper actuator, and the mechanism of changing the damping coefficient differs for different semi-active damper actuators FIG. 3A shows a block diagram of a method for controlling an operation of an elevator system according to some embodiments of the invention. Various embodiments of the invention change 350 a damping coefficient of a semi-active damper actuator connected to the elevator rope in response to the receiving 340 an amplitude and a velocity of a sway of the elevator rope determined during the operation of the elevator system. Steps of the method can be performed by a processor 301.

Some embodiments change the damping coefficient according to a function 360 of the amplitude and the velocity of the sway. In some embodiments, the function is a switching function defining the switching condition 365 for changing the values of the damping coefficient. For example, one embodiment updates the damping coefficient according to a sign of the function. In various embodiments, the function 360 is used by a control law for controlling the semi-active damper actuator.

Control Law

Some embodiments determine the control law to control the semi-active damper 130. The semi-active damper changes the damping of the elevator rope based on the control law. One embodiment determines the control law for the case of one assumed mode, i.e., equation (1) with N=1, as described below. However, other embodiments similarly determine the control law for any number of modes. In various embodiments, the assumed mode is a mode of vibration of the elevator rope characterized by a modal frequency and a mode shape, and is numbered according to the number of half waves in the vibration of the elevator rope.

Figure 3B:
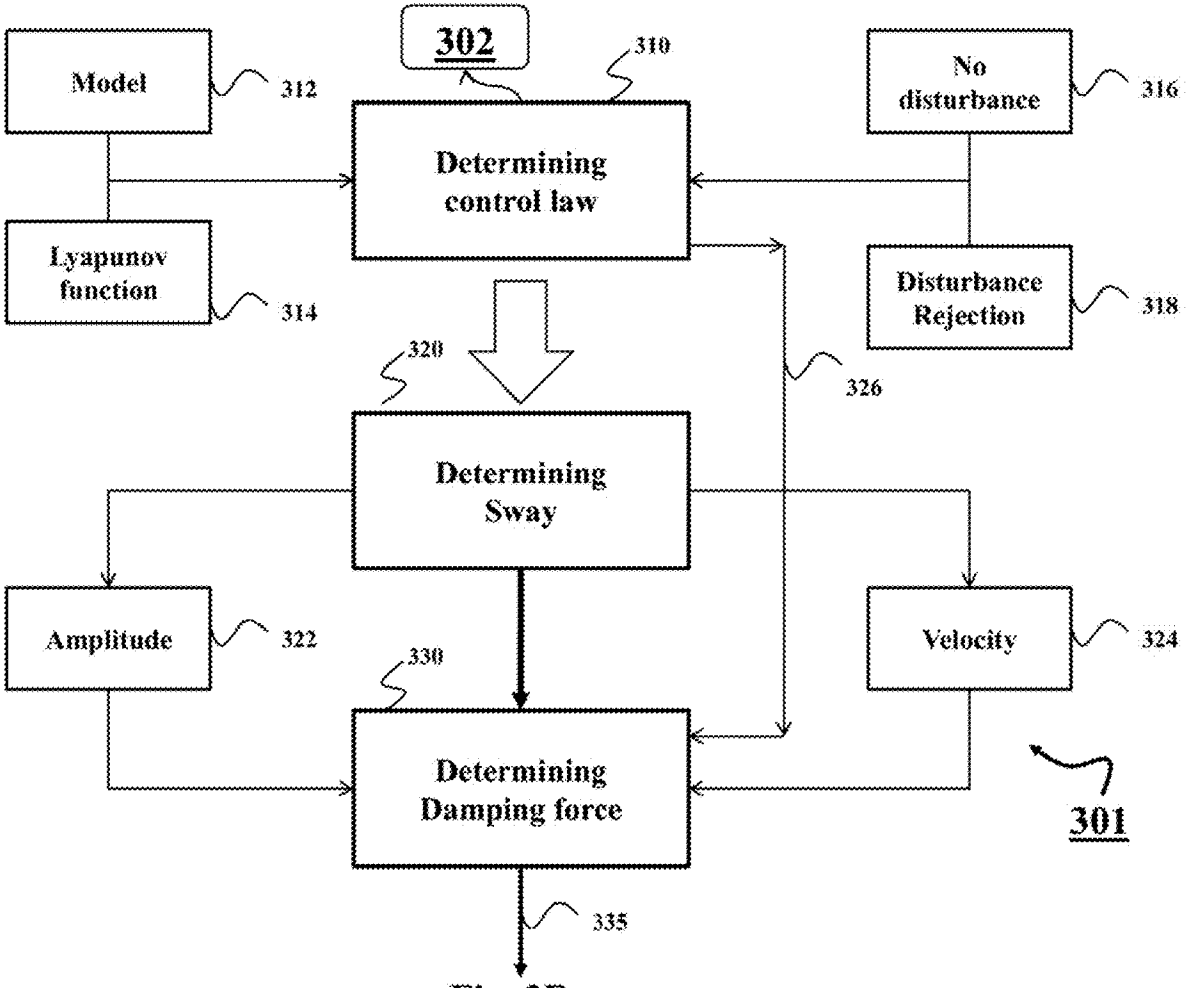
FIG. 3B is a block diagram of a method for controlling the operation of the elevator system according to an embodiment of the invention.

FIG. 3B shows a block diagram of a method for controlling an operation of an elevator system. The method can be implemented using a processor 301. The method determines 310 a control law 326 stabilizing a state of the elevator system using a damping force 335 of an elevator rope supporting an elevator car in the elevator system. The control law is a function of an amplitude 322 of a sway of the elevator rope and a velocity 324 of the sway of the elevator rope, and determined such that a derivative of a Lyapunov function 314 along dynamics of the elevator system controlled by the control law is negative definite. The control law can be stored into a memory 302. The memory 302 can be of any type and can be operatively connected to the processor 301.

The negative definiteness requirement of the Lyapunov function ensures the stabilization of the elevator system and reduction of the sway. Also, determining the control based on Lyapunov theory allows applying the damping force optimally, i.e., only when necessary to reduce the sway, and thus reduce the maintenance cost of the elevator system and the overall energy consumption. For example, the damping force can be applied based on a sign of a product of the amplitude of a sway of the rope and the velocity of the sway of the rope.

One embodiment determines the control law 326 based on a model 312 of the elevator system with no disturbance 316. The disturbance include external disturbance such as a force of the wind or seismic activity. This embodiment is advantageous when the external disturbance is small or quickly dissipated. However, such embodiment can be suboptimal when the disturbance is large and steady.

Another embodiment modifies the control law with a disturbance rejection component 318 to force the derivative of the Lyapunov function to be negative definite. This embodiment is advantageous for elevator systems subject to a long term disturbance. In one variation of this embodiment, the external disturbance is measured during the operation of the elevator system. In another embodiment, the disturbance rejection component is determined based on the boundaries of the external disturbance. This embodiment allows for compensating for disturbance without measuring the disturbance.

During the operation of the elevator system, the method determines 320 the amplitude 322 and the velocity 324 of the sway of the elevator rope. For example, the amplitude and the velocity can be directly measured using various samples of the state of the elevator system. Additionally or alternatively, the amplitude and the velocity of the sway can be estimated using, e.g., a model of the elevator system and reduce number of samples, or various interpolation techniques. Next, the damping force 335 applied to the elevator rope by the semi-active damper actuator, such as actuators 130-134, is determined based on the control law 326, and the amplitude 322 and the velocity 324 of the sway of the elevator rope.

Lyapunov Control

Some embodiments use the damping force applied to the rope by the semi-active actuator and the Lyapunov theory to stabilize the elevator system, and thus stabilize the sway. By combining the Lyapunov theory and the rope damping actuation, the control unit 150, according to some embodiments, optimizes switching the control ON and OFF based on switching conditions, e.g., amplitude and velocity of the actual sway. The switching condition as well as the amplitude of the positive damping coefficient, i.e. damping force, to be applied is obtained based on the Lyapunov theory.

One embodiment defines a control Lyapunov function V(x) as $$V(x) = \frac{1}{2}\dot{q}^T(t)M\dot{q}(t) + \frac{1}{2}q^T(t)Kq(t),$$

wherein, q, $\dot{q}$ are the Lagrangian variables representing the assumed mode and its time derivative, M, K are the mass and the stiffness matrix respectively, defined in the model of Equation (2), and $x=[q, \dot{q}]^T$, where T is a transpose operator.

If the assumed mode equals one, then the Lagrangian variables q, $\dot{q}$ are related to the sway u(y,t) and the sway velocity du(y,t)/dt by the equations $$u(y, t) = \frac{\sqrt{2}\sin\left(\frac{\pi y}{l}\right)q(t)}{\sqrt{l}};$$

$$du(y, t)/dt = \frac{\sqrt{2}\sin\left(\frac{\pi y}{l}\right)\dot{q}(t)}{\sqrt{l}}.$$

Figure 4A:
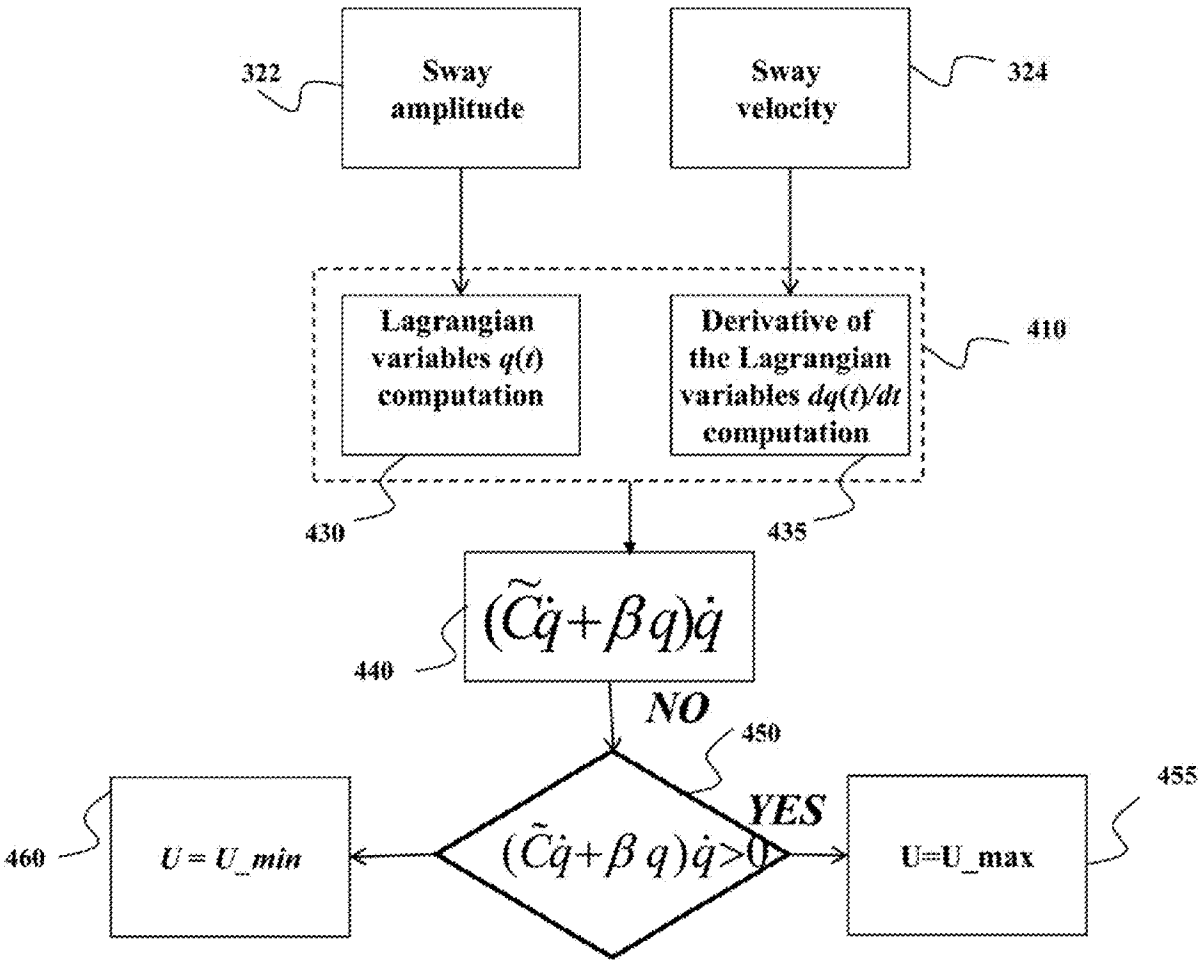
FIGS. 4A and 4B are block diagrams of methods for determining the control law based on Lyapunov theory according to various embodiments of the invention.

FIG. 4A shows a block diagram of a method for determining the control law based on Lyapunov theory. The Lagrangian variables q, $\dot{q}$ 430 and 435 are determined 410 based on the amplitude u(y,t) 322 and velocity du(y,t)/dt 324 sway. For example, one embodiment determines the Lagrangian variables according to $$q(t) = \frac{\sqrt{l}\,u(y, t)}{\sqrt{2}\sin\left(\frac{\pi y}{l}\right)},$$

$$\dot{q}(t) = \frac{\sqrt{l}\,du(y, t)/dt}{\sqrt{2}\sin\left(\frac{\pi y}{l}\right)}.$$

The sway amplitude u(y, t) and velocity du(y,t)/dt can be directly measured or estimated using various methods. For example, one embodiment determines the sway using sway sensors sensing the sway of the elevator rope at sway locations. Another embodiment determines the amplitude of the sway using samples of the sway and the model of the system. After the sway amplitude is determined, some embodiment determines the sway velocity using, e.g., a first order derivative $$du(y, t)/dt = \frac{u(y, t+\delta t) - u(y, t)}{\delta t},$$

wherein δt is the time between two sway amplitude measurements or estimations.

Some embodiments, determines the control law such that a derivative of the Lyapunov function along dynamics of the elevator system controlled by the control law U is negative definite. One embodiment determines the derivative of the Lyapunov function along the dynamics, e.g., represented by Equation (1), of the elevator system without disturbances, i.e. F(t)=0, $\tilde{F}(t)=0$ for all t, according to $$\dot{V}(x) = \dot{q}\left(-C\dot{q} - \tilde{C}\dot{q}U - Kq - \beta qU\right) + Kq\dot{q}$$
$$= -C\dot{q}^2 - \left(\tilde{C}\dot{q} + \beta q\right)\dot{q}U,$$

wherein coefficients C, $\tilde{C}$, K and β are determined according to the Equation (1).

To ensure the negative definiteness of the derivative $\dot{V}$, the control law according to one embodiment changes the damping coefficient of the semi-active damper actuator according to $$U(x) = \begin{cases} \text{u_max} & \text{if}\left(\tilde{C}\dot{q} + \beta q\right)\dot{q} > 0 \\ \text{u_min} & \text{if}\left(\tilde{C}\dot{q} + \beta q\right)\dot{q} \le 0 \end{cases}. \tag{3}$$

In some embodiments u_min is equal to zero.

This control law switches between two constants, e.g., u_min which is positive constant representing the minimum damping coefficient of the semi-active damper and u_max, which is positive constant representing the maximum the maximum damping coefficient of the semi-active damper. A controller according to a control law (3) stabilizes the elevator system with no disturbance by switching between a maximal and a minimal damping coefficient of the semi-active damper 130. This controller is easy to implement and is advantageous when the disturbance is unknown or minimal.

For example, in some embodiments, the damping coefficient value is based on a sign of a function based on the amplitude of a sway of the rope and the velocity of the sway of the rope. The function is determined 440 and the sign is tested 450. If the sign is positive, then a maximal damping coefficient 455 is applied. If the sign is negative, then a minimal damping coefficient 460 is applied, e.g., no damping coefficient is applied, i.e., U=0.

Figure 4B:
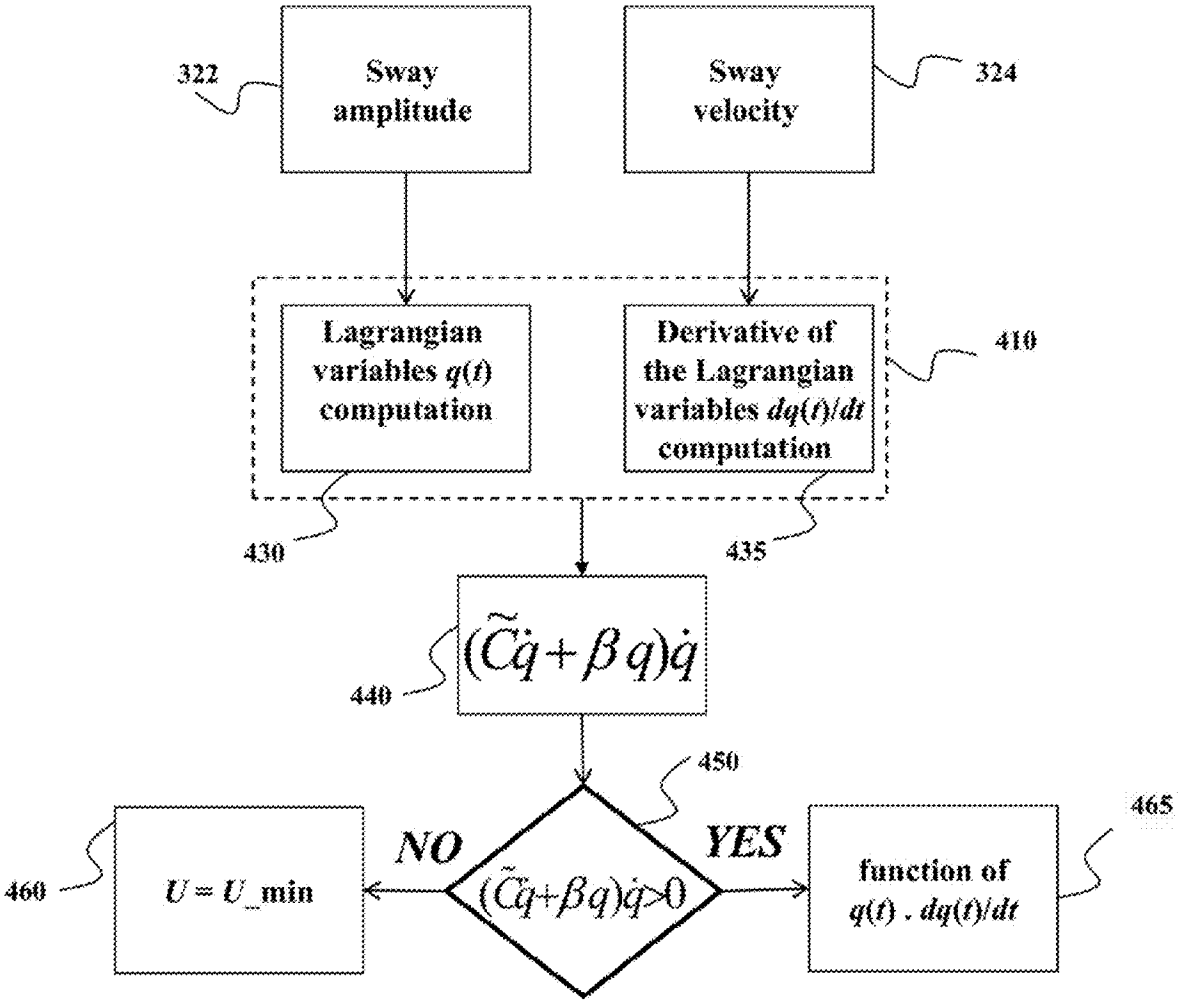

FIG. 4B shows a block diagram of an alternative embodiment that ensures the negative definiteness of the derivative $\dot{V}$. In this case, the damping coefficient of the semi-active damper actuator 130 generating the damping force applied to the elevator rope according to a varying function 465 of the amplitude and the velocity of the sway. In comparison with the previous embodiment, this embodiment can be advantageous because the embodiment uses less energy to control the sway.

According to this embodiment, the control law U(x) of the damping coefficient is $$U(x) = \begin{cases} \dfrac{k\left(\tilde{C}\dot{q} + \beta q\right)\dot{q}}{\sqrt{1 + \left(\left(\tilde{C}\dot{q} + \beta q\right)\dot{q}\right)^2}} & \text{if}\left(\tilde{C}\dot{q} + \beta q\right)\dot{q} > 0 \\ \text{u_min} & \text{if}\left(\tilde{C}\dot{q} + \beta q\right)\dot{q} \le 0 \end{cases} \tag{4}$$

wherein k is a positive feedback gain less than u_max.

This choice of controllers leads to $$\dot{V}(x) \le 0,$$

which by the global Krasovskii-LaSalle theorem for switched systems and the structure of the dynamics (1) with control laws according to Equations (3) or (4) implies that (q, $\dot{q}$)=(0, 0) is globally exponentially stable when disturbance F(t)=0. The positive varying control 465 decreases with the decrease of the amplitude of the product q$\dot{q}$, which means when the sway amplitude decreases the force applied to control also decreases. Thus, this varying control law uses less energy.

Under the control according to the control law of Equation (4), the amplitude of the control decreases with the decreasing amplitudes of q, $\dot{q}$, and $|U| \le u_{max}$. Thus, the control law is determined such that the damping coefficient of the semi-active damper is proportional to the amplitude of the sway of the elevator rope, and uses high damping coefficient when the sway or its velocity is high, because when the product q, $\dot{q}$ decreases the control damping decreases too.

Control Under Disturbance

The controllers (3), (4) stabilizes the elevator system when the disturbance F(t)=0, $\tilde{F}$(t)=0, but when the disturbance F(t), $\tilde{F}$(t) is not zero, the Lyapunov function derivative is no longer forced to be zero all the time, because the derivative $\dot{V}$ is $$\dot{V}(x) = \dot{q}\left(-C\dot{q} - \tilde{C}U\dot{q} - Kq - \beta Uq\right) + Kq\dot{q} + \dot{q}F(t) + \dot{q}\tilde{F}(t)U$$
$$= -C\dot{q}^2 - \tilde{C}U\dot{q}^2 - \beta Uq\dot{q} + \dot{q}F(t) + \dot{q}\tilde{F}(t)U,$$

where the coefficients C, K and β are defined for Equation (1).

Due to the disturbance, the global exponential stability of the closed-loop dynamics of the elevator system can fail. However, some embodiments are based on a realization that a state vector is bounded for bounded disturbance F(t), $\tilde{F}$(t). Thus, the control law for the elevator system without the external disturbance 316 can be modified with a disturbance rejection component 318 to ensure that the derivative of the Lyapunov function is negative definite. Moreover, the disturbance rejection component can be determined based on boundaries of the external disturbance F(t). This embodiment is advantageous when the direct measurement of the disturbance is not desirable.

Some embodiments determine a disturbance rejection component v(x) using Lyapunov reconstruction techniques. The control law without external disturbance $U_{nom}$ is modified with the disturbance rejection component 318 according to $$U(x) = U_\{\text{nom}\}(x) + v(x)$$

In this case the Lyapunov derivative is $$\dot{V}(x) = \dot{q}(-C\dot{q} - \tilde{C}U\dot{q} - Kq - \beta Uq) + Kq\dot{q} + \dot{q}F(t) - \beta vq\dot{q} + \dot{q}U\tilde{F}(t) \le -\beta vq\dot{q} - C\dot{q}^2 v + \dot{q}F(t) + \dot{q}U\tilde{F}(t).$$

Some embodiments select v such that $\dot{V}$(x) is negative definite. For example, one embodiment selects v satisfying $$v(x) = (\tilde{k}|U_\{\text{nom}\}| + \tilde{h})\text{sign}(\tilde{C}\dot{q}^2 + \beta q\dot{q} - \tilde{F}(t)\dot{q})(F_\{\text{max}\} + \epsilon)|\dot{q}|\tilde{k} > 0, \tilde{h} > \mathbf{0}, \epsilon > \mathbf{0}, F_\{\text{max}\} \ge \max(F(t), \tilde{F}(t)), \forall t$$

where F_max represents an upper bound of the disturbance F(t), and $\tilde{F}$(t), $\tilde{C}$ β are defined from Equation (1) and a sign function is $$\text{sgn}(v) := \begin{cases} 1 & \text{if } v > 0 \\ -1 & \text{if } v < 0 \end{cases}.$$

The above-described embodiments can be implemented in any of numerous ways. For example, the embodiments may be implemented using hardware, software or a combination thereof. When implemented in software, the software code can be executed on any suitable processor or collection of processors, whether provided in a single computer or distributed among multiple computers. Such processors may be implemented as integrated circuits, with one or more processors in an integrated circuit component. Though, a processor may be implemented using circuitry in any suitable format.

Further, it should be appreciated that a computer may be embodied in any of a number of forms, such as a rack-mounted computer, a desktop computer, a laptop computer, minicomputer, or a tablet computer. Also, a computer may have one or more input and output devices. These devices can be used, among other things, to present a user interface. Such computers may be interconnected by one or more networks in any suitable form, including as a local area network or a wide area network, such as an enterprise network or the Internet. Such networks may be based on any suitable technology and may operate according to any suitable protocol and may include wireless networks, wired networks or fiber optic networks.

Also, the various methods or processes outlined herein may be coded as software that is executable on one or more processors that employ any one of a variety of operating systems or platforms. Additionally, such software may be written using any of a number of suitable programming languages and/or programming or scripting tools, and also may be compiled as executable machine language code or intermediate code that is executed on a framework or virtual machine. For example, some embodiments of the invention use MATLAB-SIMULIMK.

In this respect, the invention may be embodied as a computer readable storage medium or multiple computer readable media, e.g., a computer memory, compact discs (CD), optical discs, digital video disks (DVD), magnetic tapes, and flash memories. Alternatively or additionally, the invention may be embodied as a computer readable medium other than a computer-readable storage medium, such as a propagating signal.

The terms "program" or "software" are used herein in a generic sense to refer to any type of computer code or set of computer-executable instructions that can be employed to program a computer or other processor to implement various aspects of the present invention as discussed above.

Computer-executable instructions may be in many forms, such as program modules, executed by one or more computers or other devices. Generally, program modules include routines, programs, objects, components, and data structures that perform particular tasks or implement particular abstract data types. Typically the functionality of the program modules may be combined or distributed as desired in various embodiments.

Also, the embodiments of the invention may be embodied as a method, of which an example has been provided. The acts performed as part of the method may be ordered in any suitable way. Accordingly, embodiments may be constructed in which acts are performed in an order different than illustrated, which may include performing some acts simultaneously, even though shown as sequential acts in illustrative embodiments.

Although the invention has been described by way of examples of preferred embodiments, it is to be understood that various other adaptations and modifications can be made within the spirit and scope of the invention. Therefore, it is the object of the appended claims to cover all such variations and modifications as come within the true spirit and scope of the invention.

I claim:

1. A method for controlling an operation of an elevator system, comprising:

receiving an amplitude of a sway of an elevator rope and a velocity of the sway of the elevator rope determined during the operation of the elevator system;

modifying, in response to the receiving, a damping coefficient of a semi-active damper actuator connected to the elevator rope according to a function of the amplitude and the velocity of the sway, wherein steps of the method are performed by a processor; and determining a control law stabilizing a state of the elevator system, wherein the control law determines a value of the damping coefficient based on the function, such that the value of the damping coefficient ensures a negative definiteness of a derivative of a control Lyapunov function, wherein the control law assigns the value of the damping coefficient of the semi-active damper actuator based on a sign of a product of the amplitude of the sway of the elevator rope and the velocity of the sway of the elevator rope.

2. The method of claim 1, wherein the modifying is according to a sign of the function.

3. The method of claim 1, wherein the control law is determined such that the value of the damping coefficient of the semi-active damper actuator is proportional to the amplitude of the sway of the elevator rope.

4. The method of claim 1, wherein the control law determines a switching condition for the value of the damping coefficient based on a sign of the function.

5. The method of claim 1, wherein the control law assigns the value of the damping coefficient of the semi-active damper actuator based on a sign of a product of the amplitude of the sway of the elevator rope and the velocity of the sway of the elevator rope.

6. The method of claim 1, further comprising:

determining the control law for the elevator system based on a model of the elevator system without an external disturbance; and modifying the control law with a disturbance rejection component to force the derivative of the Lyapunov function to be negative definite with the external disturbance.

7. The method of claim 1, wherein the control law U(x) includes $$U(x) = \begin{cases} \text{u_max} & \text{if}(\tilde{C}\dot{q} + \beta q)\dot{q} > 0 \\ \text{u_min} & \text{if}(\tilde{C}\dot{q} + \beta q)\dot{q} \le 0 \end{cases},$$

wherein u_min is a positive constant representing the minimum damping coefficient of the semi-active damper and u_max is a positive constant representing a maximal damping coefficient of the semi-active damper actuator, $x=(q,\dot{q})$, and $q$, $\dot{q}$ are Lagrangian variables representing an assumed mode and a time derivative of the assumed mode, and $\tilde{C},\beta$ are coefficients of a model of the elevator system.

8. The method of claim 1, wherein the control law U(x) includes $$U(x) = \begin{cases} \dfrac{k(\tilde{C}\dot{q} + \beta q)\dot{q}}{\sqrt{1 + ((\tilde{C}\dot{q} + \beta q)\dot{q})^2}} & \text{if}(\tilde{C}\dot{q} + \beta q)\dot{q} > 0 \\ \text{u_min} & \text{if}(\tilde{C}\dot{q} + \beta q)\dot{q} \le 0 \end{cases},$$

wherein x=(q, $\dot{q}$), and q, $\dot{q}$ are Lagrangian variables representing an assumed mode and a time derivative of the assumed mode, k is a positive feedback gain less than u_max, u_min is a positive constant representing the minimum damping coefficient of the semi-active damper, u_max is a positive constant representing a maximal damping coefficient of the semi-active and $\tilde{C}$,β are coefficients of a model of the elevator system.

9. The method of claim 1, wherein the control law u(x) includes $$U(x)=U_\{\mathrm{nom}\}(x)+v(x)$$

wherein $$v(x)=(\tilde{k}|U_\{\mathrm{nom}\}|+\tilde{h})\mathrm{sign}(\tilde{C}\dot{q}^2+\beta q\dot{q}-\tilde{F}(t)\dot{q})(F_\{\max\}+\epsilon)|\dot{q}|\tilde{k}>0,\tilde{h}>0,\epsilon>0,F_\{\max\}\geq\max(F(t),\tilde{F}(t)),\forall t$$

wherein x=(q, $\dot{q}$), and q, $\dot{q}$ are Lagrangian variables representing an assumed mode and a time derivative of the assumed mode, and $\tilde{k}$, $\tilde{h}$, ϵ are positive gains, $\tilde{C}$,β are coefficients obtained from a model of the elevator system, F_{max} represents an upper bound of a disturbances F(t) and F, $\tilde{F}$, U_{nom} represents a control law without the disturbance and a sign function is $$\mathrm{sgn}(v):=\begin{cases}1 & \text{if } v>0\\ -1 & \text{if } v<0\end{cases}.$$

10. The method of claim 1, wherein the semi-active damper actuator is placed between a top of an elevator car and a main rope, or between a top of a counterweight and the main rope.

11. The method of claim 1, wherein the semi-active damper is placed between a bottom of an elevator car and a compensation rope or between a bottom of a counterweight and the compensation rope.

12. An elevator system, comprising:

an elevator car and a counterweight of the elevator car;

an elevator rope connected to the elevator car or to the counterweight;

a semi-active damper actuator connected to the elevator rope;

a sway unit for determining an amplitude of a sway of an elevator rope and a velocity of the sway of the elevator rope; and a control unit for determining a damping coefficient of the semi-active damper actuator according to a function of the amplitude and the velocity of the sway of the elevator rope, wherein the control unit determines the damping coefficient according a control law stabilizing a state of the elevator system, wherein the control law determines a value of the damping coefficient based on the function, such that the value of the damping coefficient ensures a negative definiteness of a derivative of a control Lyapunov function, wherein the control law includes a disturbance rejection component to force the derivative of the Lyapunov function to be negative definite with an external disturbance.

13. The elevator system of claim 12, wherein the control unit determines the damping coefficient according to a sign of the function.

14. The elevator system of claim 12, wherein the control law is determined such that the value of the damping coefficient of the semi-active damper actuator is proportional to the amplitude of the sway of the elevator rope.

15. The elevator system of claim 12, wherein the control law determines a switching condition for the value of the damping coefficient based on a sign of the function.

16. The elevator system of claim 12, wherein the control law assigns the value of the damping coefficient of the semi-active damper actuator based on a sign of a product of the amplitude of the sway of the elevator rope and the velocity of the sway of the elevator rope.

17. A method for controlling an operation of an elevator system, comprising:

receiving an amplitude of a sway of an elevator rope and a velocity of the sway of the elevator rope determined during the operation of the elevator system;

modifying, in response to the receiving, a damping coefficient of a semi-active damper actuator connected to the elevator rope according to a function of the amplitude and the velocity of the sway;

determining a control law stabilizing a state of the elevator system, wherein the control law determines a value of the damping coefficient based on the function, such that the value of the damping coefficient ensures a negative definiteness of a derivative of a control Lyapunov function;

determining the control law for the elevator system based on a model of the elevator system without an external disturbance; and modifying the control law with a disturbance rejection component to force the derivative of the Lyapunov function to be negative definite with the external disturbance, wherein steps of the method are performed by a processor.

* * * * *